US007508351B2

(12) United States Patent
Greenleaf et al.

(10) Patent No.: US 7,508,351 B2
(45) Date of Patent: Mar. 24, 2009

(54) HEATED COVER FOR SATELLITE DISH

(76) Inventors: James O. Greenleaf, P.O. Box 2067, Mammoth Lakes, CA (US) 93546; Rita M. Greenleaf, P.O. Box 2067, Mammoth Lakes, CA (US) 93546

( * ) Notice: Subject to any disclaimer, the term of this patent is extended or adjusted under 35 U.S.C. 154(b) by 422 days.

(21) Appl. No.: 11/412,656

(22) Filed: Apr. 26, 2006

(65) Prior Publication Data

US 2006/0250313 A1 Nov. 9, 2006

Related U.S. Application Data

(60) Provisional application No. 60/677,623, filed on May 4, 2005.

(51) Int. Cl.
*H01Q 1/42* (2006.01)

(52) U.S. Cl. ..... 343/872

(58) Field of Classification Search ..... 343/872, 343/704, 912, 840

See application file for complete search history.

(56) References Cited

U.S. PATENT DOCUMENTS

| | | | | |
|---|---|---|---|---|
| 4,866,452 | A | 9/1989 | Barma et al. | |
| D304,454 | S | 11/1989 | Serres | |
| 5,451,972 | A * | 9/1995 | Franklin | 343/840 |
| 5,617,107 | A * | 4/1997 | Fleming | 343/704 |
| 5,729,241 | A | 3/1998 | Ergen et al. | |
| 5,815,125 | A | 9/1998 | Kelly et al. | |
| 5,861,855 | A | 1/1999 | Arsenault | |
| 5,920,289 | A * | 7/1999 | Jones | 343/704 |
| 5,940,047 | A | 8/1999 | Pfnister | |
| 6,064,344 | A | 5/2000 | Walton | |
| 6,100,851 | A * | 8/2000 | Jones | 343/704 |
| 6,191,753 | B1 * | 2/2001 | Ellis et al. | 343/872 |
| D446,206 | S | 8/2001 | Hochendoner | |
| 6,317,088 | B1 | 11/2001 | Lindsay et al. | |
| D453,328 | S | 2/2002 | Thaw | |
| 6,485,152 | B2 | 11/2002 | Wood | |
| 6,714,167 | B1 * | 3/2004 | Gusick, Jr. | 343/872 |

* cited by examiner

*Primary Examiner*—Huedung Mancuso

(57) ABSTRACT

One possible embodiment of the invention could be a heated cover for satellite dishes comprising a flexible cover, a flexible heating element, flexible disk, and a flexible attachment device, the flexible heating element being sandwiched between a flexible cover and a flexible disk, and a flexible attachment device attaches the flexible cover to the satellite dish, wherein the flexible cover, flexible heating element, flexible and a flexible attachment device are capable of being folded generally allowing the heated cover to be folded into a compact state when not in use.

14 Claims, 8 Drawing Sheets

HEATED COVER FOR SATELLITE DISH

CROSS-REFERENCES TO RELATED APPLICATIONS

This application claims the benefit of U.S. Provisional Patent Application No. 60/677623, filed on May 04, 2005, contents of which are relied upon and incorporated by reference.

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention substantially relates to covers for satellite dishes. In particular, the present invention may relate to those satellite dish covers, which may be heated.

BACKGROUND

When a person or other entity generally subscribes to a satellite television service (e.g., a satellite broadcast of a television or other suitable mass media means transmission), the service may first arrange for necessary equipment to be setup that generally allows the subscriber to receive and make use of the satellite transmission (e.g., see the satellite broadcast on a television set.) The equipment setup generally occurs at the subscriber's location (e.g., home) and may first involve substantially attaching satellite reception equipment (e.g., the satellite dish) generally on the outside structure of a building or alike that is proximate to the subscriber's location. This setup may further include generally connecting the satellite dish to a satellite signal receiver, followed by generally connecting the satellite receiver to a television set, computer or other suitable electronic device.

In operation, the satellite dish may be generally oriented towards the position in the sky where the service's broadcast satellite could be held in a geostationary orbit. This orientation is generally required to allow the satellite dish to receive the satellite broadcast signal. Upon receipt of the broadcast signal from the satellite, the satellite dish may generally relay it to the satellite receiver, which may then substantially decode or otherwise make the broadcast signal compatible for use by the subscriber's electronic equipment (e.g., television set.)

One of the banes of satellite transmission system could be snowfall. While snowfall itself generally does not significantly interfere with the transmission of the satellite signal though the atmosphere, an accumulation of snow and/or ice on the satellite dish may significantly impair the reception of the satellite broadcast signal to such an extent as to substantially interfere with the receipt of the signal. Many satellite service providers (after being contacted by their irate patrons regarding such interruptions in service) promptly instruct their patrons in such situations to take an ordinary house broom, or other suitable brush device, go to the satellite dish and then brush off or otherwise remove the accumulation from the satellite dish. During a heavy snowfall or the like, the subscriber may have to remove this accumulation several times in order to maintain satellite transmission reception.

There may be some difficulties associated with such accumulation removal actions. A significant number of satellite dishes, to effectively receive the satellite signal, may need to have an unobstructed line-of-sight orientation to the point in the sky where the service's satellite in geostationary orbit is positioned for proper satellite signal transmission. This line-of-sight orientation may require the satellite dish to be placed high on the side or top of the building or other suitable structure to avoid any relevant obstructions. Therefore, in order for the subscriber (or other person suitably designated by the subscriber) to reach and remove accumulation from the highly placed satellite dish, the subscriber may need to engage in height reaching activities. These activities may include, but not necessarily be limited to, using a very long handled bush (e.g., a clumsy combination of a broom taped to an extension pole), climbing (e.g. using a ladder or like), or combinations thereof.

In non-snow times, these height-reaching activities may be somewhat risky. However, during a snowfall, where the accumulation of snow and ice may result in very slippery surfaces, such accumulation removal activities may become downright dangerous. Such repeated acrobatic activities could result in personal injuries (e.g., a slip and fall from a height). Additionally, areas receiving heavy snowfall may require the accumulation removal person to also traverse the fallen snow and the like (drifted and otherwise) just to get to structure where the satellite dish is situated thus generally being exposed to further hardship and potential injury.

What is needed therefore is a device and methodology whereby reception interfering accumulation on a satellite dish may be generally removed without the need for direct, repeated human intervention for the accumulation removal.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to remove ice/snow accumulation from a satellite dish without the operator substantially having to access height, the ability to remove accumulation from a satellite dish during a snowstorm without having the operator to generally access an outside environment where the satellite dish is located, the ability to remove snow accumulation from a satellite dish without the operator substantially having to physically contact the satellite dish, provide an accumulation removal device that is generally easily and reversibly secured to the satellite dish and can be activated as necessary, provide a flexible and easy to store accumulation removal device for satellite dish, the ability to compact the accumulation removal device for storage and transport, the ability to remove accumulation from a satellite dish during a snow storm by engaging in one action during a snowfall, and provide an accumulation removal device that once is installed once on the satellite dish can be activated when necessary.

These and other advantages may be realized by reference to the remaining portions of the specification, claims, and abstract.

BRIEF DESCRIPTION OF ONE EMBODIMENT OF THE PRESENT INVENTION

One possible embodiment of the invention could be a heated cover for satellite dishes comprising a flexible cover, a flexible heating element located proximate to the flexible cover, and a flexible attachment device for attaching the flexible cover to the satellite dish, wherein the flexibility of the flexible cover, flexible heating element, and flexible attachment is sufficient to allow the heated cover to be placed into a compact state.

Another version of the invention could be a flexible heated cover for a satellite dish comprising a flexible cover means for covering a concave portion of the satellite dish; a flexible heating means for imparting heat to the flexible cover means; and a flexible attachment means for reversibly attaching the flexible cover means to the satellite dish.

Another version of the invention could be method of operating a flexible heated satellite dish cover, comprising of the following steps, but not necessarily limited to the order presented below unfolding the flexible heated satellite dish cover from a compact state, attaching the flexible heated satellite dish cover to a satellite dish cover, and energizing the flexible heated satellite dish cover.

The above-description sets forth, rather broadly, a summary of one embodiment of the present invention so that the detailed description that follows may be better understood and the contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
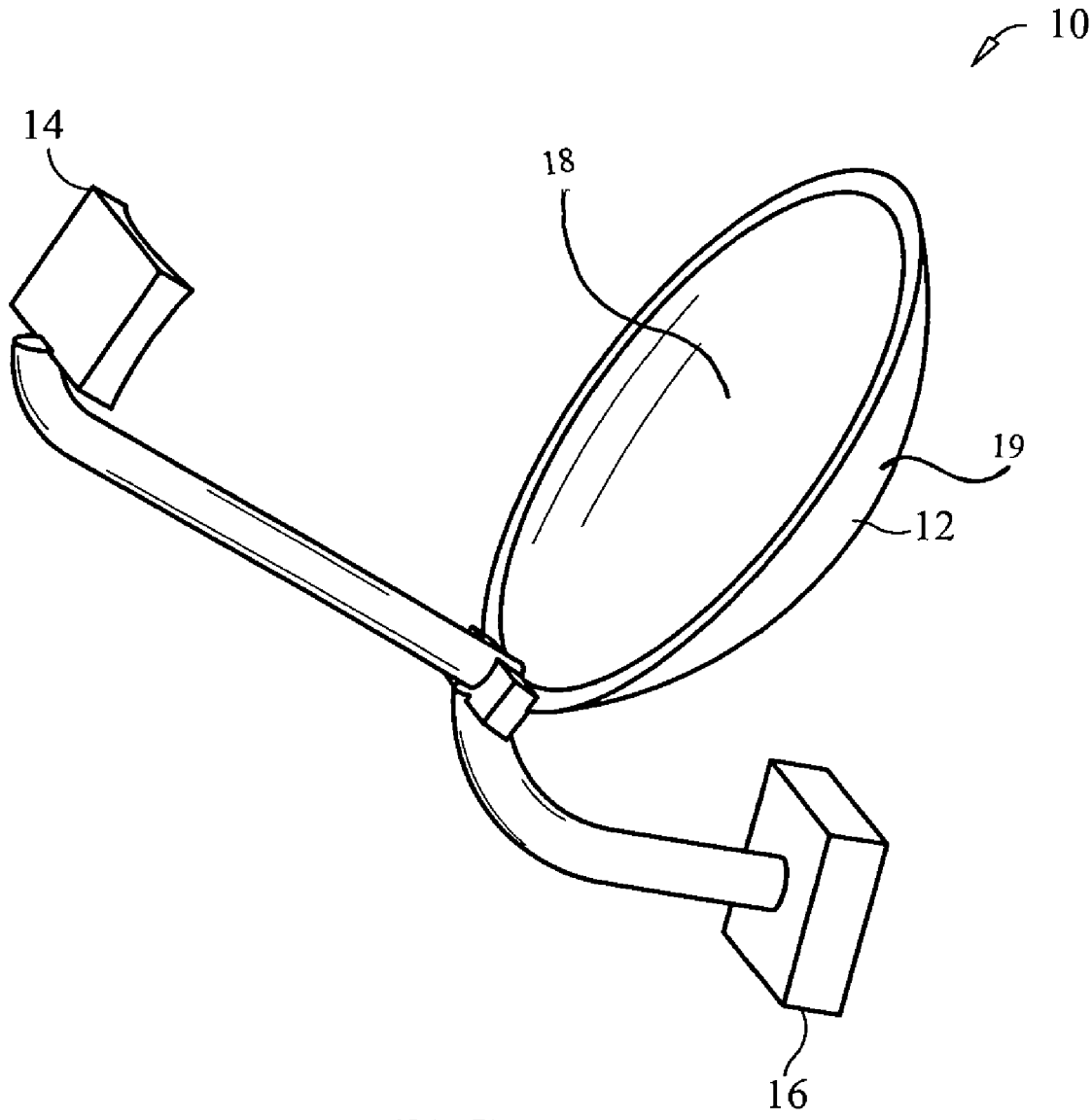
FIG. 1 is substantially a frontal view of satellite dish.
Figure 2:
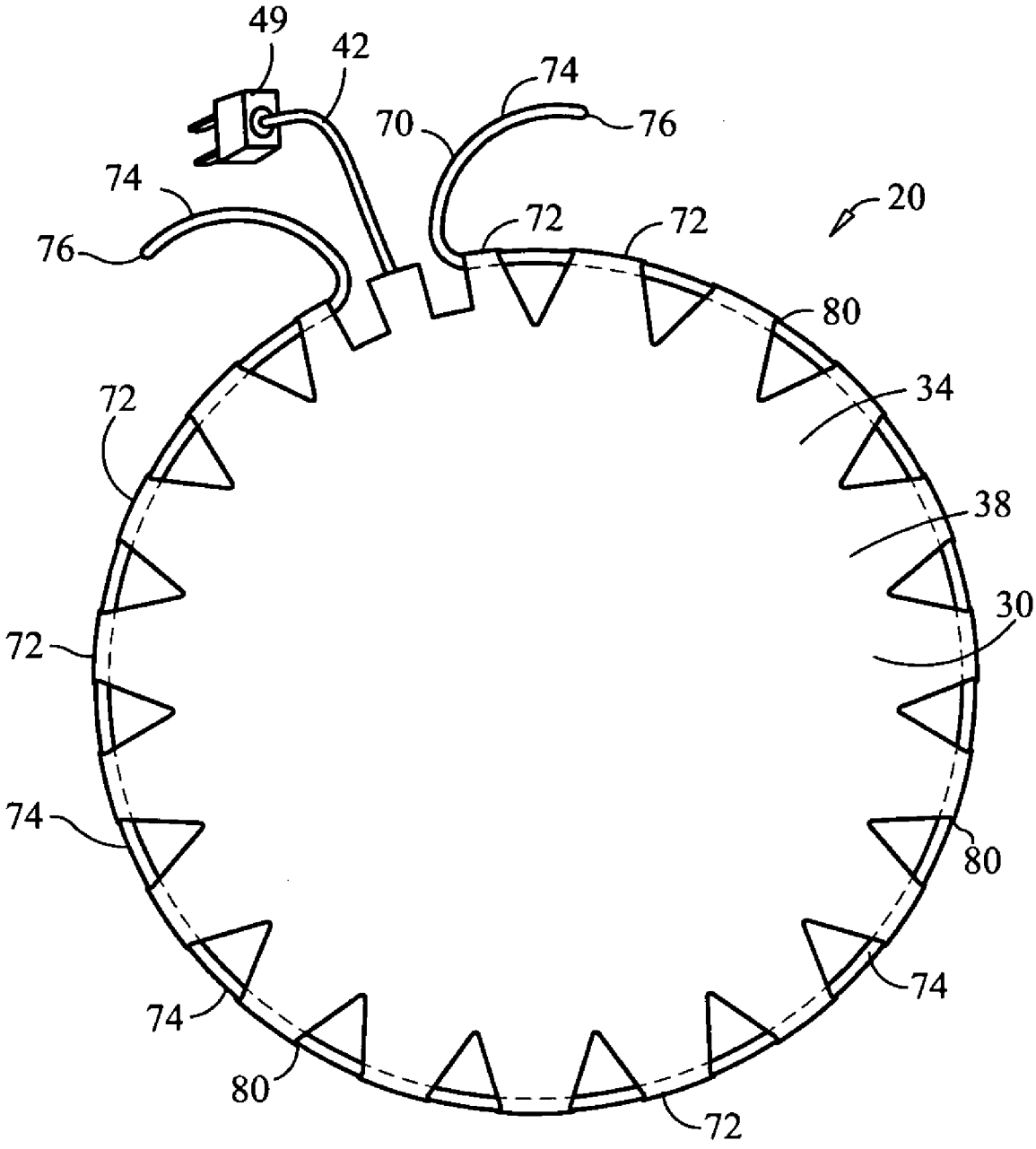
FIG. 2 is substantially a frontal view of one embodiment of the invention.
Figure 2A:
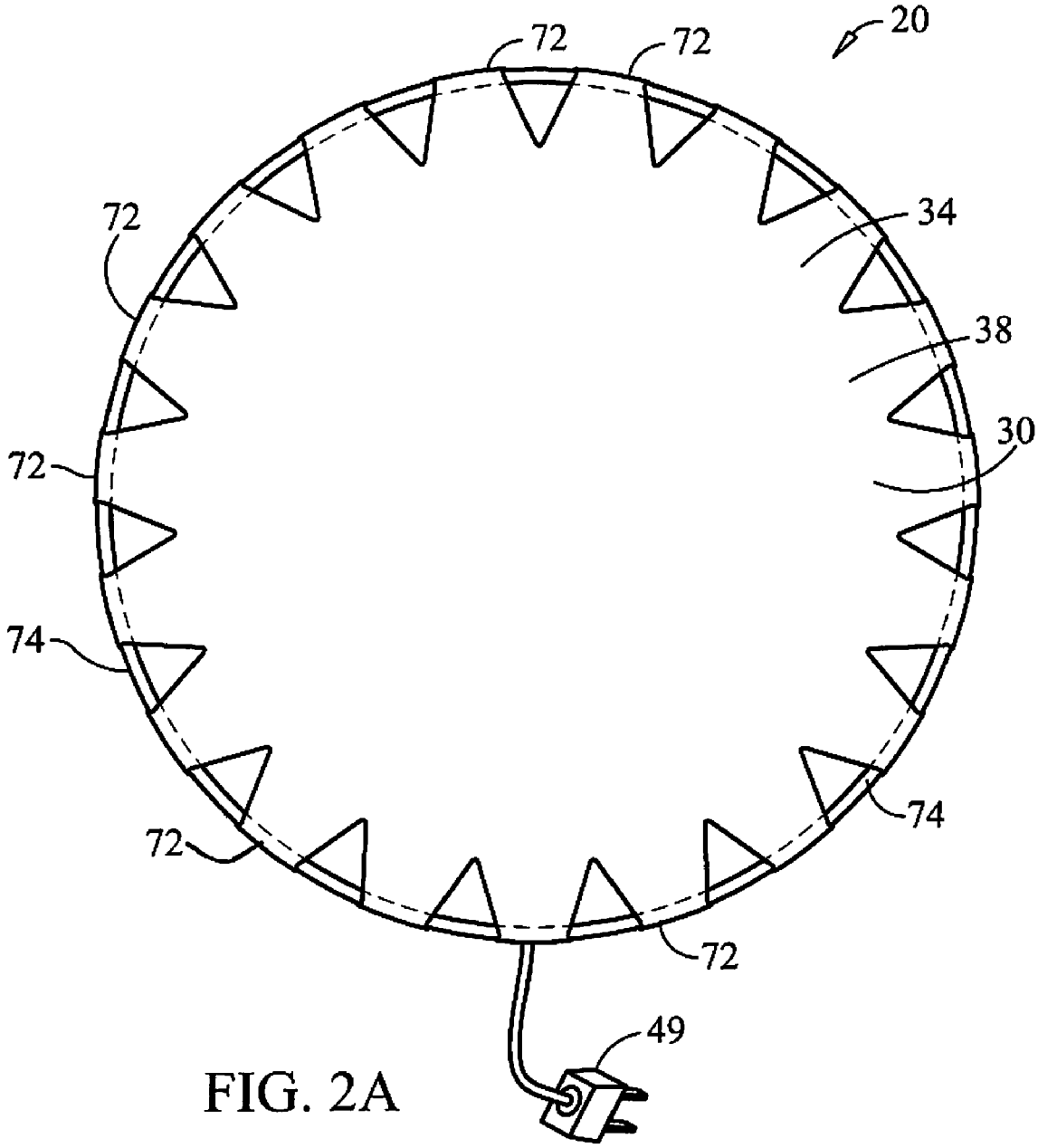
FIG. 2A is substantially a frontal view of another embodiment of the invention.

As substantially shown in FIG. 1, the present invention, in at least one embodiment may be applied to and cover portions of a satellite dish 10. The satellite dish 10 may comprise a bowl 12, substantially designed to reflect and concentrate the satellite signals to a signal receiver 14, which generally projects outward from a lip of the concave portion 18 of the bowl 12; and a mounting device 16 attached to the bowl 14, for attaching the bowl 12 to a desired structure (not shown). The satellite dish 10 may be orientated towards a position in the sky where the service's satellite is placed through a geosynchronous orbit. To meet this orientation, the bowl 12 could have an angled or slanted orientation.

As generally shown in FIGS. 2-5, the invention could be a foldable heated cover 20 for a satellite dish 10. The foldable heated cover 20 could be generally reversibly secured to the satellite dish 10 by substantially placing the foldable heated cover 20 over the concave portion 18 of the bowl 12, thus generally covering the concave portion 18 of the bowl 12. Because of the bowl's slanted orientation, a substantial portion of the attached foldable heated cover 20 could be presented as a generally flat slanted surface (e.g., a covering) over the concave portion 18 of the bowl 12. In this manner, any normal accumulation (e.g., snow, ice) in the concave portion 18 of an uncovered bowl 12 may now instead generally accumulate on the slanted portion of the foldable heated cover 20 generally enclosing the concave portion 18. This orientation of the foldable heated cover 20 combined with its heating capability may cause the ice/snow accumulation on the flat slanted portion of the foldable heated cover 20 to melt and runoff (or slide off.)

In at least one embodiment, the foldable heated cover 20 may comprise of a flexible cover 30, a flexible heating element 40, a flexible securing device 50, and a flexible attachment device 80. The flexible cover 30 could be substantially a two-sided flexible disk, which in least one embodiment may further have serrated edges 72. One side of flexible cover 30 that is generally exposed to the outside elements and accumulations could be considered the front side 38 of the cover 30. The other side of the flexible cover 30 that generally facing and enclosing the concave portion 18 of the bowl 12 could be considered the rear side 36. The flexible cover 30 could be constructed in at least one embodiment to have a minimum diameter, which could allow the cover 30 to be substantially placed over and generally cover the concave portion 18 of the bowl 12 of the desired satellite dish 10.

In at least one embodiment, the flexible cover 30 (and the flexible disk 102) could be made from Ktex Coated Vinyl, model K7X85 available from Keystone Brothers, 2801 Academy Way, Sacramento, Calif. 95815, phone 916/927-5851. This material is generally known to have resistance to degradation caused by sunlight, and may allow invention to be continuously used outdoors for a long time without suffering noticeable damage from ultraviolet radiation. In at least one other embodiment, the flexible cover 30 could be made from naugahyde®, which is produced by Uniroyal Engineered Products LLC, 1001 North Main Street, Suite 6, Nappanee, Ind. 4550-1038.

The flexible heating element 40, in at least one embodiment, is made from a definite length of flexible resistance heating wire 44 with two ends 46, the wire 44 being generally formed into a loop 48. In at least one embodiment, the wire 44 may be a standard refrigerator heating element wire. The ends 46 of the wire 44 may be generally connected to an insulated, flexible two-wire electrical cord 42 that terminates to a common connector 49 such as a standard household male outlet plug that is used for applications running on a standard household current. The plug may be connected to an appropriate electrical outlet receptacle (not shown) or to a suitable extension cord(s) (not shown) that is of sufficient length or combined lengths to reach the outlet receptacle (not shown).

The loop 48 of wire 44 can be further folded in a wide a variety of patterns whose outer edge of the pattern generally has a circular or disk form. The pattern can be achieved by substantially folding the loop 48 so that portions of the loop 48 may be generally placed along one another without the sides of the portions meeting one another. The pattern selected may be chosen based on allowing the flexible heating element 40 to cover substantially a significant portion of the rear side 36 of the flexible cover 30. In this manner, the exact pattern of the heating element 40 may vary as long as the wire 44 is appropriately spaced out over the rear side 36 of the flexible cover 30 and generally does not cross over itself (e.g., the sides of the wire 44 generally do not touch or come into contact with one another).

Figure 3:
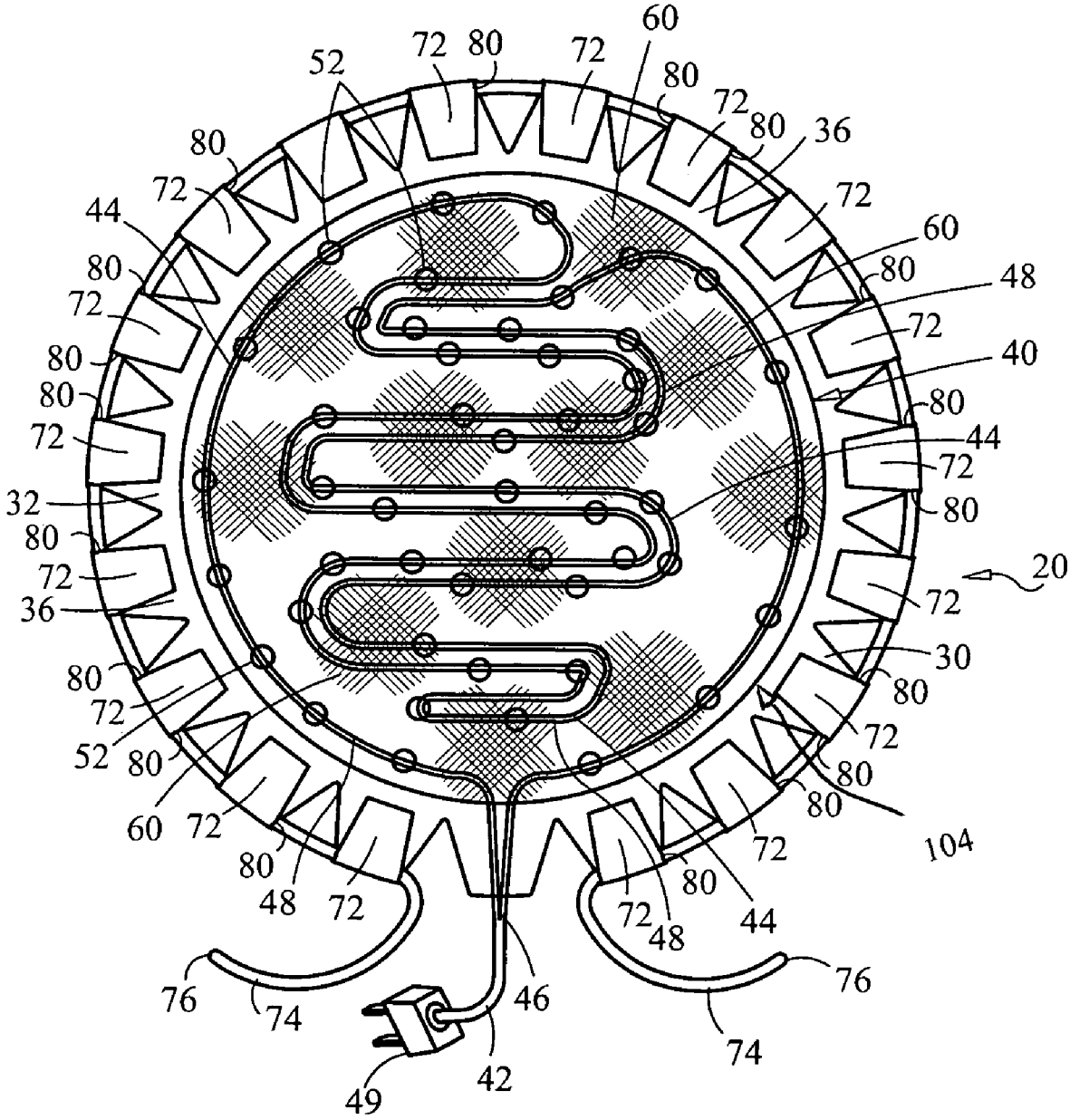
FIG. 3 is substantially a rear view of one embodiment of the invention of the invention.
Figure 3A:
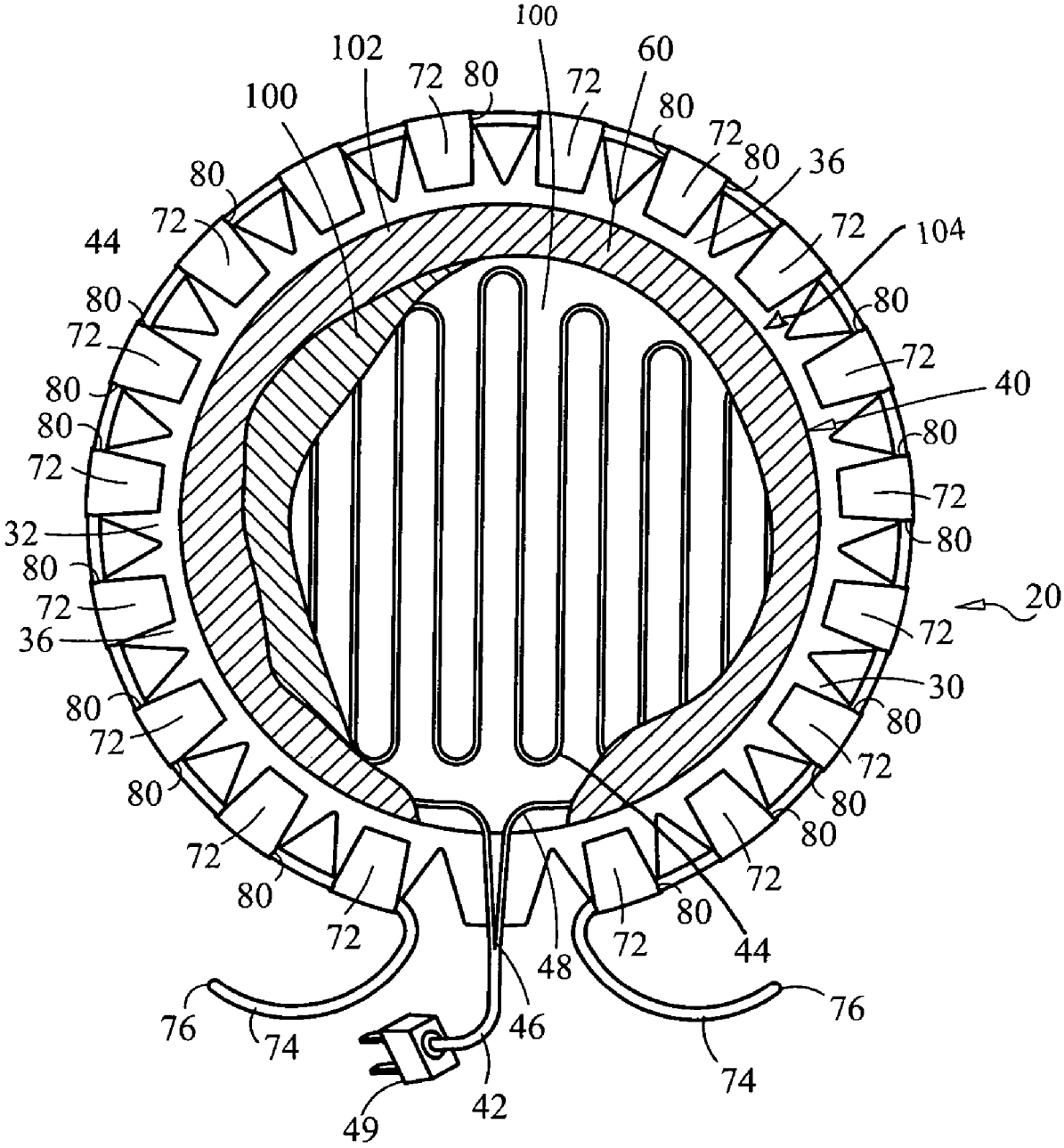
FIG. 3A is substantially a cut away rear view of another embodiment of the invention.
Figure 4:
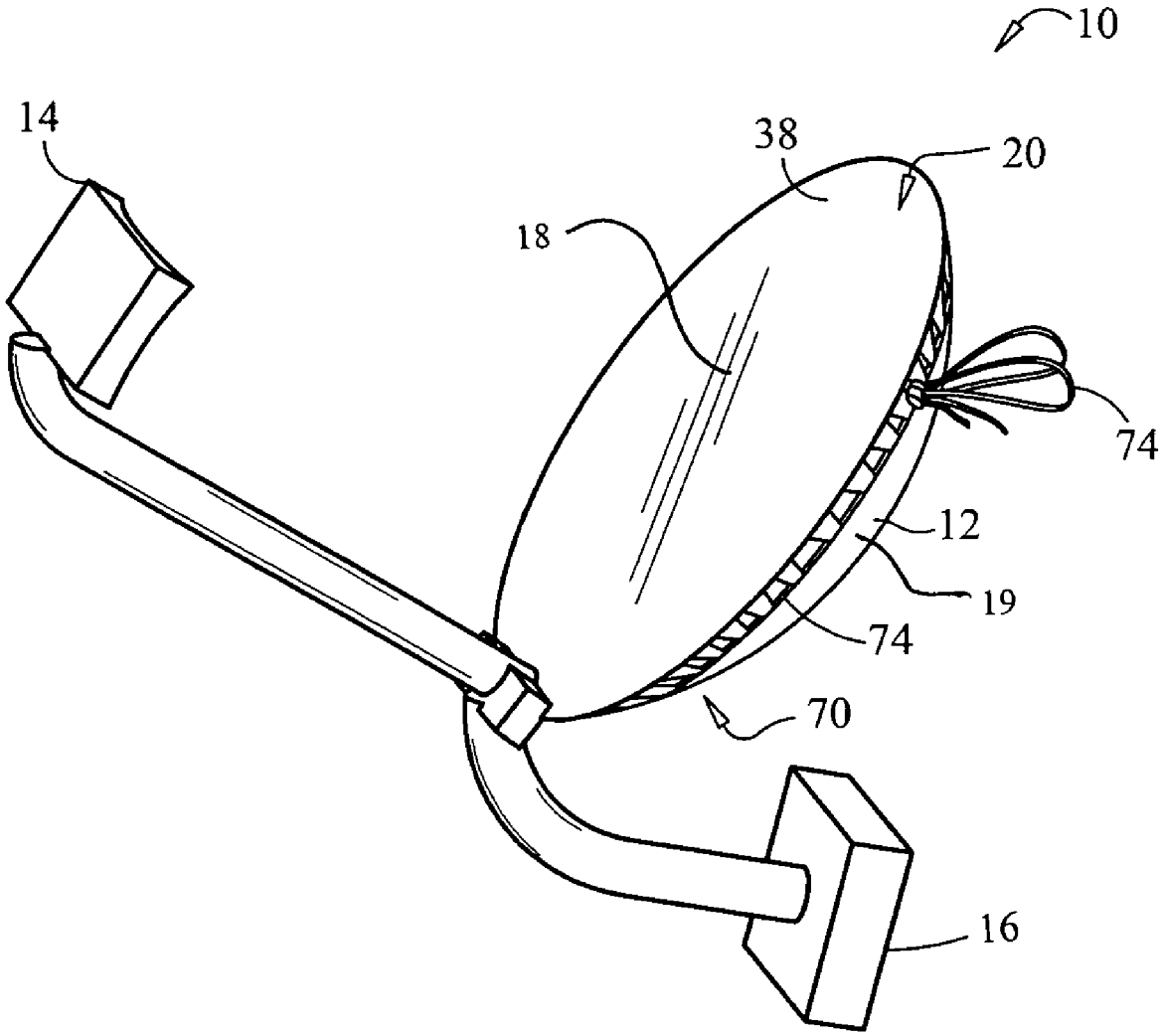
FIG. 4 is substantially a perspective frontal view of one embodiment of the invention attached to a satellite dish.
Figure 5:
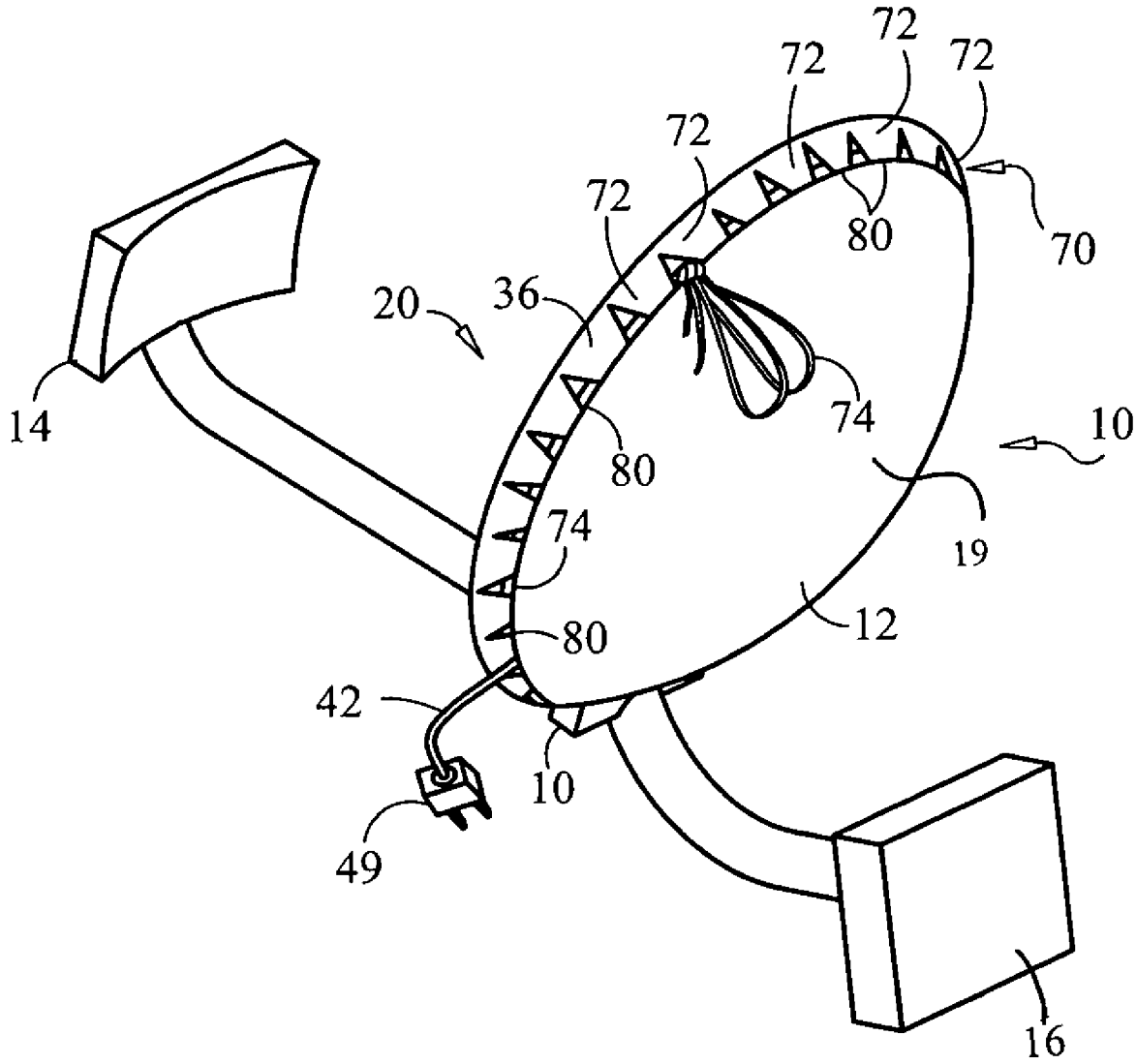
FIG. 5 is substantially a perspective rear view of one embodiment of the invention attached to a satellite dish.
Figure 6:
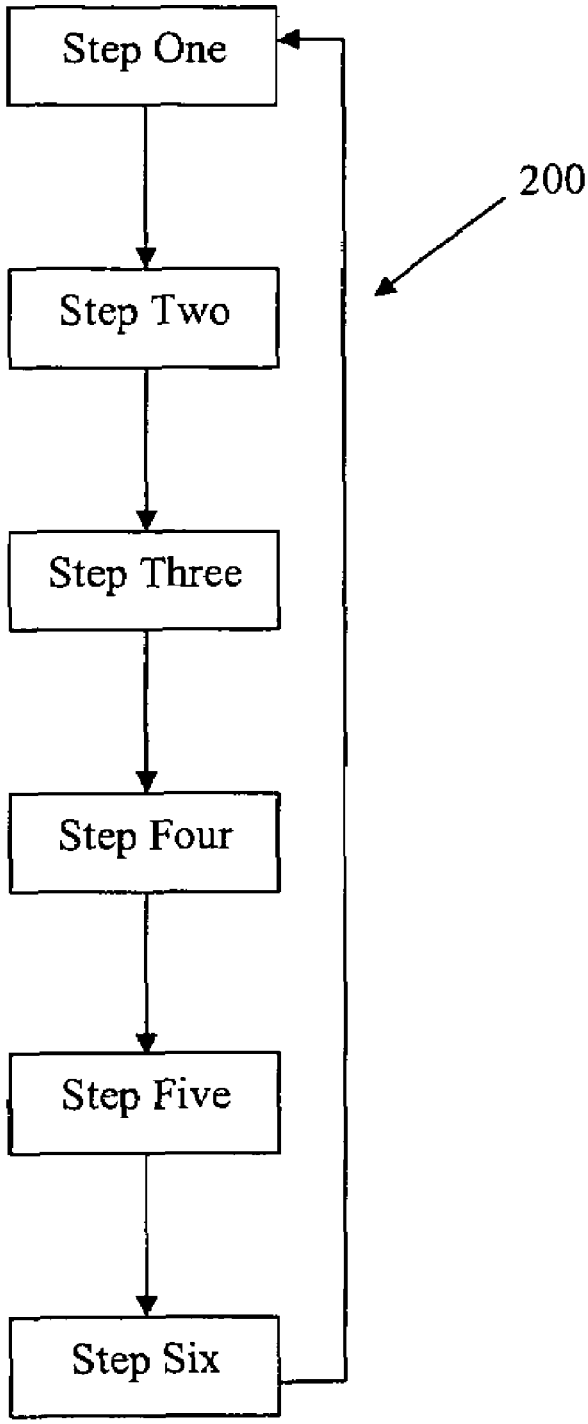
FIG. 6 is substantially a flowchart showing one possible method of operating the invention.

In at least one embodiment, as substantially shown in FIG. 3A, the wire 44 could have folded portions organized into a pattern forming upright fingers resembling a caricature of the cactus. This vertical orientation of significant portion of the wire may promote better water run off from the front side 38 than a horizontal orientation, in that an overall horizontal orientation of the wire 44 may create horizontal ridges, which may trap runoff water on the flexible cover 30.

When the wire 44 is appropriately electrified (e.g., with household current when plugged into an electric outlet receptacle) it could, in at least one embodiment, substantially dispense approximately 40-50 watts worth of heat to the flexible cover 30 (e.g., the foldable heated cover 20) depending on the size of the heated cover 20. The electrified heating element 40 could substantially disperse the heat in a generally radiant fashion to heat the flexible cover 30. This dispersed amount of radiant heat may be generally sufficient in substantially freezing temperatures to melt off that snow and ice, which may have accumulated on the foldable heated cover 20. The amount of heat provide by the invention generally could not harm the components of the foldable heated cover 20 or the satellite dish 10 during continuous operation in cold weather (e.g., when outside ambient temperatures are approximately 40° degrees Fahrenheit or below).

In one possible embodiment, the heating element 40 may further comprise a thermostatic switch (not shown) connected to the wire loop 48 in such a fashion as to substantially disrupt or otherwise generally cut off the flow of electrical power to (or through) the wire 44 when the outside ambient temperatures are above approximately 40° degrees Fahrenheit.

The flexible securing device 50 may be used to secure the flexible heating element 40 to the flexible cover 30. In one embodiment, the flexible securing device 50 could use dabs of glue 52 from a hot glue gun applied at intervals along a substantial portion of the length of the wire 44; a mesh disk 60; and a spray adhesive. The dabs of glue 52 could be used to secure the wire 44 between the rear side 36 and the mesh disk 60. Additionally, the spray contact adhesive (like those generally found in hardware stores) could also be applied to portions of the wire 44, the rear side 36, and one side of the mesh disk 60 to further secure the wire 44 to the rear side 36, between the rear side 36 and the mesh disk 60 as a laminate structure 104.

The mesh disk 60 may be a disk-shaped piece of flexible plastic window screen such as the type used for screen doors and windows and commonly found in hardware stores. The mesh disk 60 may have a diameter, which may be large enough to cover at least a substantial portion of the wire 44 when applied to the rear side 36, but is generally smaller than the diameter of the flexible cover 30. The mesh disk 60, in addition to its securing role, may possibly aid the wire 44 in substantially dispersing its radiant heat through invention.

The securing device 50 in another embodiment could further comprise of two fiberglass mat disks 100 and a flexible disk 102. The fiberglass mat disks 100 could be made from fiberglass mat such as the type used in auto repair and commonly found at hardware stores. The disks 100 could also be made from fiberglass cloth as well. The fiberglass mat disks 100 could both have generally equal diameters that are generally the same as or slightly larger than the diameter of pattern of the wire loop 48.

The two disks 100 could sandwich between them at least a portion of heating element 40 (e.g., wire 44) to form a laminate 104. To make this laminate 104, one side of each fiberglass mat disk 100 could be sprayed with spray contact adhesive of the type as discussed above. Both sides of the wire loop pattern could similarly be sprayed with the spray contact adhesive. The adhesive sprayed side of one fiberglass mat disk 100 could then be applied to one side of the pattern of the wire loop 48 while the adhesive sprayed side of the other fiberglass mat disk 100 could be applied to the other side of the pattern of the wire loop 48. This sandwiching of at least a substantial portion of the wire loop 48 between the two fiberglass mat disks 100 could generally form a fiberglass mat disk-wire loop-fiberglass mat disk laminate 104. In addition to its securing role, the fiberglass mat disks 100 may aid the wire 44 in substantially dispersing its radiant heat throughout a substantial portion of the flexible cover 30. Further, the fiberglass mat disks 102 could possibly prevent heat damage to the flexible cover 30 and the like if the invention is operating for longer periods during warm outside ambient temperatures.

Once the laminate 104 is formed, the previously unsprayed portion of one of the fiberglass mat disks 100 could now be sprayed with spray contact adhesive. A portion of the rear side 36 of the flexible cover 30 could also be sprayed with the spray contact adhesive. The laminate structure 104 could then be applied and affixed to rear side 36 of the flexible cover 30.

The laminate 104 could then be generally sealed to the rear side 36 of the flexible cover 30 using the flexible disks 102. As stated above, the flexible disk 102 could be made from the same materials as the flexible cover 30 and have a suitable diameter (e.g., larger than the laminate 104 but smaller than the flexible cover 30) to allow edge of the flexible disk 102 to contact the rear side 36. The flexible disk 102 could be attached over the unsecured side of laminate structure 104 by using suitable adhesives as discussed-above to encapsulate substantially the laminate 104 between the rear side 36 and the flexible disk 102. In at least one embodiment, Lasco's PVC Cement made by Lasco Santa Fe Springs, Calif. 90670 could also be used for attaching the flexible disk 102 to both the rear side 36 and the laminate structure 104.

In at least one embodiment, not shown, the flexible disk 102 and the flexible cover 30 could both have respective tabs which could be generally glued together over the portion of the wire electrical cord 42 that goes into the foldable heated cover 20 to provide a generally water resistant seal into the cavity formed between the flexible disk 102 and the flexible cover 30.

The flexible attachment device 70 could be used to attach the invention to the satellite dish 10. In one embodiment, the flexible attachment device 70 comprises the flexible cover's serrated edges 72 and a strap 74 (e.g. string, cord, rope, wire, etc.). Each open end of a serrated edge 72 could be folded over and be appropriately secured (e.g. using Lasco's PVC Cement) to form a loop 80. The strap 74 could then be threaded through all of the loops 80. When the rear side 36 is substantially placed over the concave portion 18 of the bowl 12, the loops 80 could be placed so they are generally located proximate to edge of the convex portion 19 (e.g., backside) of the bowl 12.

In one embodiment, the strap 74 may be of a definite length with two ends 76. When the two ends 76 of the strap 74 are substantially pulled taunt (away from the flexible cover 30), the loops 80 could then be pulled substantially snug and generally towards the center of the convex portion 19 of the bowl 12. The two ends 76 of the strap 74 could then be reversibly tied together in such a fashion as to maintain substantially the established tension or tautness of the foldable heated cover 20 over the bowl 12.

At least one embodiment of the invention could have the strap 74 be a continuous elastic band. The operator could generally stretch the strap 74 to allow the foldable heated cover 20 to be placed over the concave portion 18 of the bowl 12 with the loops 80 being placed against the convex portion 19 of the bowl 12. When the operator releases the strap 74 (e.g., the elastic band) of the present invention, the strap 74 could be constructed to provide sufficient tension as to hold the loops 80 securely against the convex portion 19 of the bowl 12 so as to securely and appropriately hold the foldable heated cover 20 onto the satellite dish 10. Other embodiments of attachment known to the art could be utilized as well and be considered within the coverage of the invention.

The inventor has generally found that the invention as described-above generally will not substantially interfere with satellite signal reception when the invention is applied to a satellite dish 10. This quality could allow the invention, de-energized, to be placed on the satellite dish 10 during a non-snow season to help keep reception interfering matter (e.g., twigs, leaves and other debris) out of the bowl 12.

Further, the flexible nature of the components of the invention generally allows the invention to be placed into compacted state (e.g. rolled or folded) for easy storage or transportation.

One possible method of operating the invention could be a process 200 that could start with step one, unfolding the flexible heated cover. In step one, the heated cover could be transported in a folded compact state (e.g., rolled or folded in a shipping box [not shown] from the manufacturer). The operator could remove the foldable heated cover 20 from its box (not shown) and unfold it from a compact state. At the substantial completion of step one, the process 200 could generally proceed to step two, attachment to the satellite dish.

At step two, attachment to satellite dish, the operator may apply the invention to a satellite dish 10 at a time convenient to the operator (hopefully not during a snowstorm, but during dry sunny weather, or at the beginning of the winter season). The operator could place the flexible heated cover 30 over the concave portion 18 of the bowl 12 of the satellite dish 10. The operator generally places the flexible attachment mechanism 70 (e.g., loops 80 and strap 74) around the convex portion 19 (e.g., backside) of the bowl 12. The operator can then tie the ends 76 of the strap 74 tightly together so that the loops 80 will be held against the backside of the bowl 12 to reversibly hold the invention to the satellite dish 10.

If the strap 74 is a continous elastic band, the operator stretches the back the loops 80 and strap 74 so they can engage the backside of the bowl 12. The operator then releases the strap 74, which is constructed to provide sufficient tension to hold the loops 80 securely against the convex portion 19 of the bowl 12 causing the foldable heated cover 20 to be reversibly secured onto the satellite dish 10. Once step two is generally completed, the process 200 could proceed onto step three energizing the invention.

At step three, energizing the invention, the operator could connect the common connector 49 of the flexible heating element 40 to a suitable receptacle (e.g., outdoor electrical outlet) either directly or through the use of an extension cord. The energizing could take place, when the outside ambient temperature is above approximately 40° degrees Fahrenheit (e.g., also when weather predictions forecasts snow precipitation within the near future.) The foldable heated cover 20 with its generally low electrical drain could be left on during (or longer) the snowstorm or series of snowstorms. The amount of heat produced by the invention, while generally sufficient to melt the snow, is generally not hot enough damage the foldable heated cover 20 itself or the satellite dish 10. Further, the application of foldable heated cover 20 over the slanted bowl 12 of the satellite dish 10 generally orients the flexible cover 30 to provide a generally slanted heated surface. This heated slanted surface generally allows snow and ice to melt or slide off the bowl 12 rather than accumulating in the concave portion 18 of the bowl 12 to interfere with satellite transmission reception. In this manner, the invention could generally be left on (during the cold season) or until the operator wants to turn invention off or until he or she can get proximate to satellite dish 10 to turn off the invention.

At step four, de-energizing the invention, could be the reverse procedure of step three. Step four could be taken after the conclusion of snow season or during a warm spell during the snow season. After the substantial completion of step four, the process 200 could proceed onto step five, removal of the invention from the satellite dish.

At step five, removal of the invention from the satellite dish, could occur at the end of the snow season, otherwise the invention (e.g., de-energized) could substantially be left on the satellite dish 12 without generally causing interference with satellite signal reception. In this manner, the invention could continue to prevent the accumulation of other reception interfering materials (e.g., leaves, twigs, debris, etc.) Step five could generally be the reverse of the procedures embodied in step two. After the substantial completion of step five, the process 200 could substantially proceed onto step six, placing the flexible heated cover 30 into a compact state.

At step six, placing the foldable heated cover 20 into a compact state, could be the general following of the reverse procedure for step one, unfolding the foldable heated cover. The operator could generally fold the invention into quarters or otherwise roll it up into a compact state and then stored the invention in an appropriate area (e.g., its box). At the end of step six, the process 200 could proceed back to step one.

CONCLUSION

As shown in the above description, the invention can be placed on satellite dish before the snow season and thus limited the exposure of the operator to activities that could be otherwise dangerous if done during snowfall or if snow and ice where present. Further limiting this exposure is the ability of the invention to operate (provide a heated slanted surface) without harm to itself or the satellite dish, thus allowing the operator to be able to activate the invention sometime before (or even during a snowstorm), then letting the storm pass before deactivating (e.g., de-energizing) the invention. The flexible nature of the invention allows for its easy attachment, removal, folding, storage and transport. Further, the stretching of the invention over the satellite dish covers up the concave portion of the bowl to present a slanted heated surface to induce snow and ice accumulation to melt off/slide off from the satellite dish.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A heated cover for satellite dishes comprising:

a) a flexible cover, b) a flexible heating element, c) a flexible securing device comprising two fiberglass mat disks that with flexible heating element form a laminate structure that attaches to the flexible cover, d) a flexible attachment device for attaching the flexible cover to the satellite dish, wherein the flexibility of the flexible cover, the laminate structure, and the flexible attachment is sufficient to allow the heated cover to be placed into a compact state.

2. The heated cover of claim 1, the flexible heating element further comprising of a definite length of wire, the wire being formed into a pattern so that none of the sides of the wire are contacting one another, the pattern having portions of wire, which are vertically oriented.

3. The heated cover of claim 1 wherein the flexible attachment device further comprises of a strap and serrated edges of the flexible cover, the serrated edges further being folded over to form loops.

4. The heated cover of claim 3 wherein the loops receive at least a portion of the strap.

5. The heated cover of claim 3 wherein the strap is a flexible elastic continuous band.

6. A flexible heated cover for a satellite dish comprising:

a) a flexible cover means for covering a concave portion of the satellite dish;

b) a flexible heating means for imparting heat to the flexible cover means;

c) a flexible securing means for holding the flexible heating means to the flexible cover means, the flexible securing means further comprising a disk means into which is placed the flexible heating means to form a laminate, the laminate attaching to the flexible cover means; and d) a flexible attachment means for reversibly attaching the flexible cover means to the satellite dish.

7. The flexible heated cover of claim 6 wherein the flexible securing means further comprises a heat damage prevention means for reducing heat damage to the flexible cover means.

8. The heated cover of claim 7 wherein the heat damage prevention means could also act as heat dispersing means for dispersing heat from the heating means to the flexible cover means.

9. The heated cover of claim 6 wherein the flexible securing means is capable of being repeatedly folded into a compact state.

10. The heated cover of claim 6 wherein the flexible cover means, the flexible heating means and the flexible attachment means are capable of being folded several times into a compact state.

11. A method of operating a flexible heated satellite dish cover, comprising of the following steps, but not necessarily limited to the order presented below:

a) providing a heated cover for satellite dishes comprising of a flexible cover, a flexible heating element, a flexible securing device comprising two fiberglass mat disks that with flexible heating element form a laminate structure that attaches to the flexible cover, a flexible attachment device for attaching the flexible cover to the satellite dish, wherein the flexibility of the flexible cover, the laminate structure, and flexible attachment device is sufficient to allow the heated cover to be placed into a compact state;

b) removing the flexible heated satellite dish cover from a compact state, c) attaching the flexible heated satellite dish cover to a satellite dish cover, and d) energizing the flexible heating element.

12. The method of operating a flexible heated satellite dish cover of claim 11 further comprising the step of placing the flexible heated satellite dish cover into a compact state.

13. The method of operating a flexible heated satellite dish cover of claim 11 wherein the placing of the flexible heated satellite dish cover into a compact state further comprises of folding the flexible heated satellite dish cover into a compact state.

14. The method of operating a flexible heated satellite dish cover of claim 11 wherein the placing of the flexible heated satellite dish cover into a compact state further comprises of rolling the flexible heated satellite dish cover into a compact state.

* * * * *